United States Patent [19]

Klappenecker et al.

[11] 3,981,493

[45] Sept. 21, 1976

[54] APPARATUS FOR SEPARATING A LETTER STACK

[75] Inventors: Karl Klappenecker, Constance; Gisbert Burkhardt, Insel Reichenau; Hans Rapparlie, Constance, all of Germany

[73] Assignee: Licentia Patent-Verwaltungs-G.m.b.H., Frankfurt am Main, Germany

[22] Filed: Feb. 27, 1974

[21] Appl. No.: 446,203

[30] Foreign Application Priority Data

Feb. 27, 1973 Germany ..... 2309765

[52] U.S. Cl. ..... 271/10; 271/34; 271/111; 271/114; 271/259

[51] Int. Cl.[2] ..... B65H 3/04; B65H 5/02

[58] Field of Search ..... 271/10, 11, 12, 13, 271/14, 15, 16, 17, 34, 35, 110, 111, 259, 118, 114

[56] References Cited

UNITED STATES PATENTS

| | | | |
|---|---|---|---|
| 3,219,339 | 11/1965 | Gutierrez | 271/34 X |
| 3,469,834 | 9/1969 | Stange et al. | 271/10 |
| 3,625,508 | 12/1971 | Shiragai et al. | 271/34 |
| 3,768,803 | 10/1973 | Stange | 271/34 |

FOREIGN PATENTS OR APPLICATIONS

| | | | |
|---|---|---|---|
| 1,187,246 | 2/1965 | Germany | 271/10 |

*Primary Examiner*—Evon C. Blunk
*Assistant Examiner*—Bruce H. Stoner, Jr.
*Attorney, Agent, or Firm*—Spencer & Kaye

[57] ABSTRACT

In an apparatus for forwarding flat items individually from a stack, a withdrawing mechanism forwards the items in succession into the gripping zone of a feed mechanism for further conveyance. Between the withdrawing mechanism and the feed mechanism there is situated a sensor which is connected to a control circuit controlling the operation of the withdrawing mechanism. The location of the sensor determines a standby position for each item. The control circuit causes operation of the withdrawing mechanism only when either the sensor senses no item present or the sensor senses the presence of an item and there is applied a call signal to the control circuit. Each item is first forwarded by the withdrawing mechanism from the stack to the standby position and is advanced by the withdrawing mechanism from the standby position into the gripping zone of the feed mechanism only when the call signal is applied to the control circuit.

11 Claims, 10 Drawing Figures

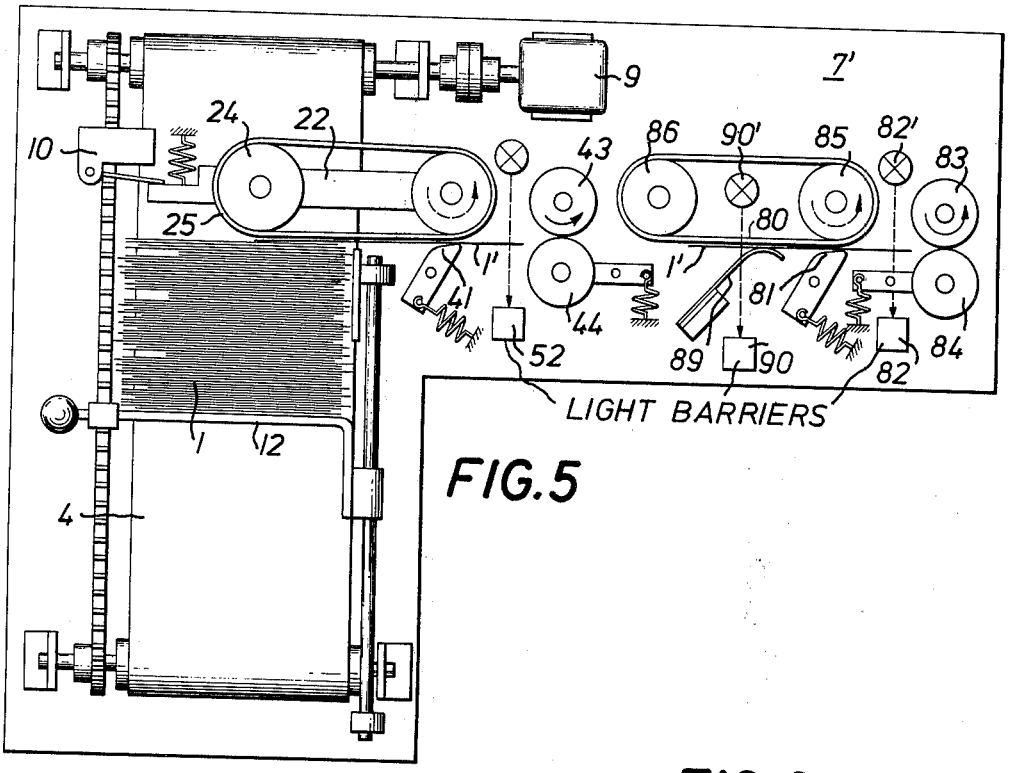
FIG. 5
FIG. 2
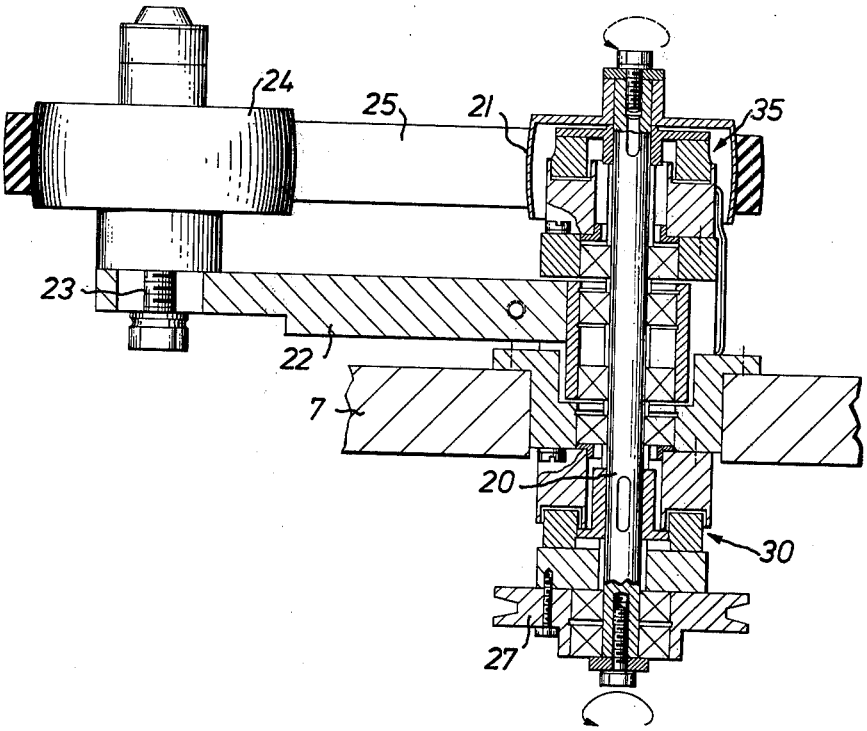

APPARATUS FOR SEPARATING A LETTER STACK

BACKGROUND OF THE INVENTION

This invention relates to an apparatus for advancing individual letters or similar flat items from a stack formed by such articles. The apparatus is of the type that has a revolving withdrawing mechanism which is in frictional contact with the foremost item in the stack and which individually advances the items past a retaining mechanism to a predetermined standby position. Upon a call signal, the items are transported from the standby position to a feed mechanism, comprising, for example, a pair of continuously driven rollers which, in turn, advance the items to a further conveyor path.

An apparatus of the above-outlined type is described, for example, in U.S. Pat. No. 3,339,917. If the withdrawal of a flat item from the stack is effected without the use of air suction and there is used only a withdrawing mechanism that frictionally engages the leading item of the stack (as disclosed in the above-mentioned patent), then, particularly in the further processing of letters which usually have different weights and frictional properties, one has to take into account that the time necessary for the removal of the item from the stack and its acceleration to the circumferential speed of the withdrawing mechanism are not constant. In known devices these time differences are eliminated by advancing each item only up to a predetermined standby position and then — in their already separated condition — they are subsequently "called" from the standby position. Thus, the items are not called directly from the stack.

In the known apparatus, the standby position is constituted by an abutment controlled by the call signal. The distance of the abutment from the withdrawing mechanism is preferably smaller than the length of the shortest item. The advancing force of the withdrawing mechanism is a continuously rotating roller provided with a friction surface, may therefore be only so large that even a thin item, when it is retained by its leading edge at the abutment, is not advanced in the zone of the withdrawing mechanism and thus does not undergo buckling or crumpling. This measure, however, may give rise to difficulties when heavier items have to be withdrawn from the stack. Further, the structural design of the controlled abutment also involves problems involving wear and operational noise.

SUMMARY OF THE INVENTION

It is an object of the invention to provide an improved apparatus of the above-outlined type that is adapted to perform the separation of the items with high operational safety with the elimination of the drawbacks inherent in the prior art.

This object and others to become apparent as the specification progresses, are accomplished by the invention according to which, briefly stated, the withdrawing mechanism is caused to operate by a control circuit only when either a sensor, disposed between the withdrawing mechanism and the downstream arranged feed mechanism senses no item present, or the sensor senses the presence of an item and there is applied a call signal to the control circuit. Each item is first forwarded by the withdrawing mechanism from the stack to the standby position determined by the sensor and is advanced by the withdrawing mechanism from the standby position into the gripping zone of the feed mechanism only when the call signal is applied to the control circuit.

BRIEF DESCRIPTION OF THE DRAWINGS

FIG. 2 is a side elevational view, partially in section, of one part of the apparatus illustrated in FIG. 1.

FIG. 5 is a schematic plan view of a second embodiment of the invention.

DESCRIPTION OF THE PREFERRED EMBODIMENTS

Figure 1:
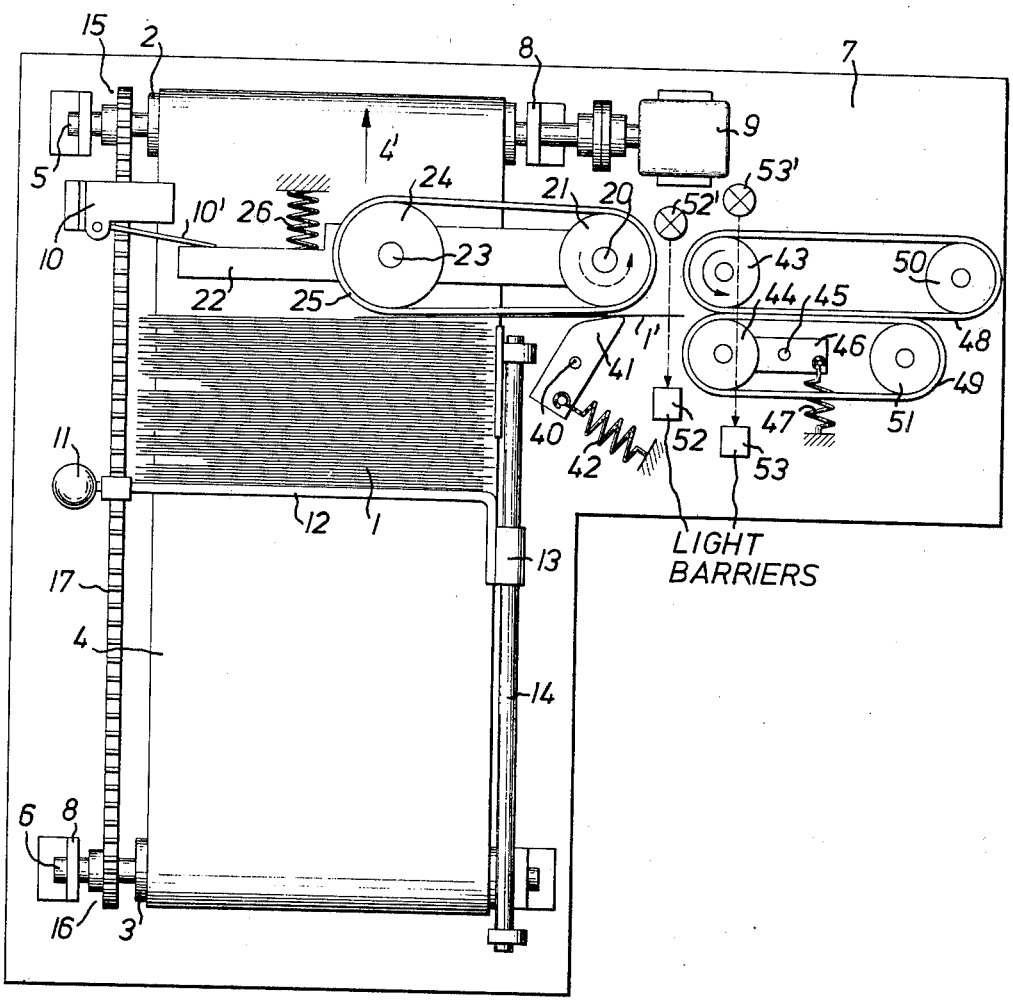
FIG. 1 is a schematic plan view of a first embodiment of the invention.

Turning now to FIG. 1, the apparatus illustrated therein includes a base belt 4 which serves as a support for a stack 1 formed of letters or similar flat items and which is trained about end rollers 2 and 3. Two pairs of brackets 8 affixed to a base plate 7 serve as bearings for the shafts 5 and 6 of the respective rollers 2 and 3. The shaft 5 is coupled to a drive motor 9 which, as described later, is controlled in such a manner by a microswitch 10 attached to the base plate 7 that it drives, when required, the base belt 4 in the direction of the arrow 4'.

The trailing end of the stack 1 is supported by means of a backup plate 12 provided with a handle 11. To the backup plate 12 there is affixed a sleeve 13 which is disposed laterally of the base belt 4 and which is slidably and rotatably arranged on a bar 14. In this manner the backup plate 12 is pivotable and is displaceable parallel to the base belt 4. On the shafts 5 and 6 there are mounted aligned respective sprockets 15 and 16 about which there is trained a chain 17 into which there extends, from above, a lug (not shown) forming part of the backup plate 12. Thus, any time the base belt 4 is driven, the backup plate 12 moves with the base belt 4 as a unit. For introducing additional items into the stack 1, the backup plate 12 is pivoted upward away from the stack by manipulating the handle 11. This releases the plate 12 from the chain 17, so that the plate 12 may be shifted along the bar 14 according to the total thickness of the newly introduced items.

Turning now to FIG. 2, in the base plate 7 there is freely rotatably supported a shaft 20 to which there is affixed a roller 21. The shaft 20 serves for the pivotal support of a rocker 22 which, at its free end, carries the shaft 23 of a withdrawing roller 24. About the roller 21 and the withdrawing roller 24 there is trained a withdrawing belt 25, the outer surface of which is made of a material having a high coefficient of friction.

The rocker 22 is biased by a spring 26 (shown schematically in FIG. 1), one end of which is attached to the base plate 7. In this manner it is ensured that the angular position of the rocker 22 at any time depends upon the pressure force exerted thereon by the stack 1. The free end of the rocker 22 cooperates with the actuating lever 10' of the microswitch 10. In case the pressure force of the stack is too small, the rocker 22 causes the microswitch 10 to close whereby the drive motor 9 is energized. As a result of this energization, the base belt 4 is driven and thus the backup plate 12 is, through the chain 17, moved in the direction of the withdrawing roller 24 until, upon reaching the position corresponding to the predetermined pressure force of the stack exerted on the rocker 22 through the withdrawing roller 24, the rocker 22 opens the microswitch 10.

On the shaft 20 there is supported a freely rotatable belt pulley 27 which is continuously driven by a motor, not shown. By virtue of an electromagnetic clutch 30 of known construction, the shaft 20 may be coupled to the belt pulley 27 in a torque-transmitting manner, in which case then the roller 21 and the withdrawing belt 25 are driven in the direction of the arcuate arrow shown in broken lines in FIG. 1. To the shaft 20, on the one hand, and to the rocker 22, on the other hand, there are affixed components of an electromagnetic brake 35 which may be of similar construction as the clutch 30. When the electromagnetic brake 35 is energized, the shaft 20 is connected in a torque-transmitting manner with the rocker 22. A control circuit which is associated with the clutch 30 and the brake 35 and which will be described later in detail, is designed in such a manner that the components 30 and 35 are energized and de-energized in an opposing manner. Thus, when the clutch 30 is released, the brake 35 is simultaneously applied, and conversely. In this manner a very rapid starting and stopping of the withdrawing belt 25 is possible.

Referring once again to FIG. 1, opposite the roller 21 in the conveying path of the items there is disposed a retaining mechanism, such as a stripper 41 which is pivotable about a shaft 40 and which is urged by means of a spring 42 against the withdrawing belt 25 or, as the case may be, against the items 1' advanced by the belt 25. The coefficient of friction of that surface of the stripper 41 which is oriented towards the items is, as known, smaller than that of the withdrawing belt 25.

Along the conveying path of the advancing items 1' there is disposed a pair of continuously rotating feed rollers 43 and 44. In the embodiment according to FIG. 1, the feed roller 43 is supported on the base plate 7, while the feed roller 44 is freely rotatably held on a lever 46 which, in turn, is pivotally held on a shaft 45. The feed roller 44 is urged against the feed roller 43 by means of a spring 47 in a resiliently yielding manner. In this embodiment the feed rollers 43 and 44 serve as end rollers for the feed belts 48 and 49 which are respectively supported by additional driven end rollers 50 and 51. Components 43 to 51 thus constitute a feed mechanism which is disposed downstream of and spaced from components 21, 24 and 25 which, in turn, comprise a withdrawing mechanism.

Between the stripper 41 and the feed rollers 43, 44 there is disposed a sensor, such as a light barrier 52, 52' for sensing the presence or absence of an item 1'.

There is provided a further sensor, such as a light barrier 53, 53' in the gripping zone of the feed mechanism 43–51. The light barriers transmit a logic one (1) if they are not darkened by an item 1' (i.e. they are clear) and transmit a logic zero (0) if such a darkening occurs.

Figure 3:
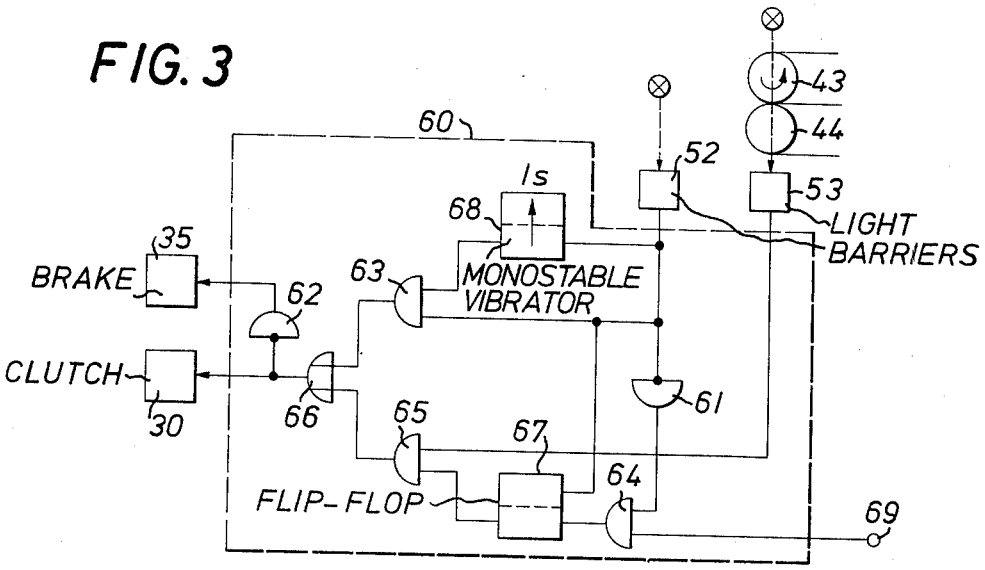
FIG. 3 is a diagram of a control circuit adapted to be associated with the apparatus illustrated in FIG. 1.

Turning now to FIG. 3, there is schematically shown an embodiment of a control circuit 60 adapted to be associated with an apparatus illustrated in FIG. 1. The circuit includes inverters 61 and 62, AND gates 63, 64 and 65, an OR gate 66, a bistable flip-flop circuit 67 and a timing switch (a monostable "one-shot" multivibrator) 68. If the light barrier 52 applies a signal to the input of the timing switch 68, the latter transmits an output signal for a duration of one second. By virtue of the cooperation between the elements 63 and 68 there appears a signal at the output of the AND gate 63 as long as the light barrier 52 is clear but no longer than for 1 second. To the input terminal 69 there is applied the call signal of the successive processing station to which the items are to be admitted at a desired moment.

The embodiment illustrated in FIGS. 1, 2 and 3 thus operates in the following manner:

It is assumed that after energizing the apparatus, the light barrier 52 is clear (undarkened). As a result, the upper input of the flip-flop 67 is set, so that at its output which is connected with an input of the AND gate 65, no signal appears. At the output of the AND gate 63, on the contrary, there appears a signal which, through the OR gate 66 and the inverter 62 causes release of the brake 35 and closing of the clutch 30. In this manner the roller 21 sets in motion the withdrawing belt 25 and the withdrawing roller 24. If now, by the withdrawing belt 25 an item 1' is removed from the stack 1 and advanced into the zone of the light barrier 52, 52', then the output signal of the latter disappears. As a result, the signal at the output of the OR gate 66 also disappears. As a consequence, within a very short time the clutch 30 is released and the brake 35 is applied. The braking period during the stoppage of the withdrawing belt 25 and the distance between the light barrier 52, 52' and the feed rollers 43, 44 are designed in such a manner that the leading edge of each item is advanced only slightly beyond the light barrier 52, 52'. Thus, in no way does the item at this time arrive in the gripping zone of the feed rollers 43, 44.

In case no stack 1 is present in the apparatus, or for any other reason no withdrawal of an item 1' took place, the withdrawing belt 25 is, despite the undarkened condition of the light barrier 52 automatically stopped after one second.

Subsequent to the above-described withdrawal, the item 1' is thus stationary and waits in the "standby position" at the light barrier 52, 52' upstream of the gripping zone of the feed rollers 43, 44. Since the light barrier 52 transmits no signal, the AND gate 64 is prepared through the inverter 61. If now through the input terminal 69 there is applied a call signal to the lower input of the AND gate 64, the output of the AND gate 64 sets the lower input of the flip-flop 67. As a result, the latter applies a signal to one input of the AND gate 65. Since the undarkened light barrier 53 applies a signal also to the second input of the AND gate 65, the AND gate 65 transmits an output signal which, through the OR gate 66 and the inverter 62 causes a release of the brake 35 and a closing of the clutch 30. Thus, the withdrawing belt 25 starts again and advances the above-described item from the standby position into the gripping zone of the feed rollers 43, 44. As soon as the light barrier 53 too is darkened by the advanced item, the signal from the output of the AND gate 65 disappears. Upon this occurrence the clutch 30 is released and the brake 35 is applied. The withdrawing belt 25 immediately stops; the item 1', however, continues to be advanced by the feed rollers 43, 44 and is thus pulled out of the effective range of the withdrawing belt 25. The item 1' is forwarded by the conveyor belts 48, 49 — possibly through additional conveying paths — to the successive processing station. The circumferential speed of the feed rollers 43, 44 may be the same as, or may be greater than that of the withdrawing belt 25.

As soon as the trailing edge of the called item clears the light barrier 52, the initial state of the apparatus is reestablished: the signal transmitted by the light barrier 52 effects, through the elements 68, 63 and 66 the withdrawal of the successive item from the stack 1. This successive item is, in the manner described before, forwarded only up to the light barrier 52 (standby position) and is conveyed further from the standby position into the gripping zone of the feed rollers 43, 44 only upon receipt of the call signal.

Thus, according to the invention — independently from structural details of the control circuit — the drive of the withdrawing mechanism (in this embodiment the drive of the withdrawing belt 25) is energized every time when either the sensor (in this embodiment the light barrier 52, 52') between the stripper 41 and the feed rollers 43, 44 is clear (does not sense the presence of an item), or when this sensor is not clear (that is, it senses the presence of an item) and a call signal is applied to the control circuit. It is further advantageous if the call signal becomes ineffective, thus the withdrawing mechanism is stopped, as soon as the called item arrives into the gripping zone of the feed rollers.

Figure 4:
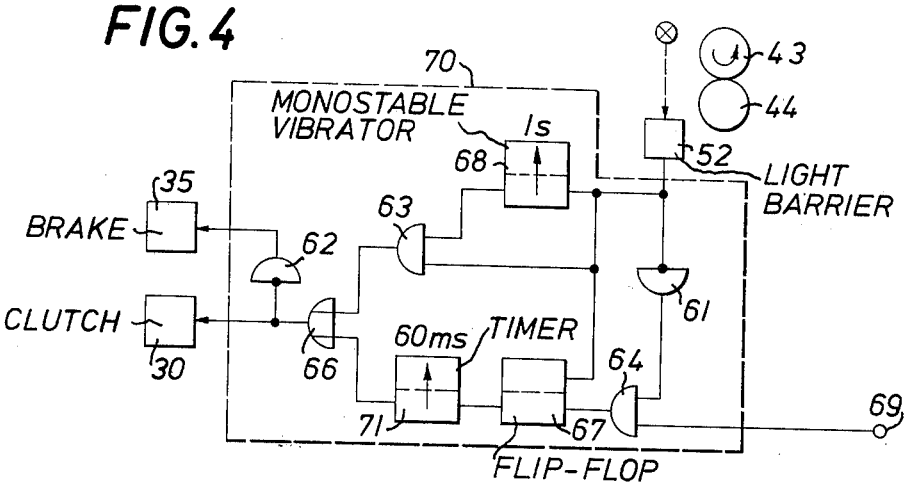
FIG. 4 is a diagram of a different control circuit adapted to be associated with the embodiment of FIG. 1.

The above-described mode of operation may be accomplished even in the absence of the light barrier 53, 53' if the control circuit is designed, for example, as shown in FIG. 4 and indicated at 70. This circuit differs from the control circuit 60 in that the function of the light barrier 53 and the AND gate 65 is taken over by a timing switch 71 having a resetting period of 60 milliseconds. If during the darkened state of the light barrier 52 (which means that the item 1' is in the standby position) a call signal is applied through the input terminal 69 to the lower input of the prepared AND gate 64 and, as a result, the flip-flop 67 is set, then the latter applies a signal to the timing switch 71 until it is again reset by the clearing (undarkening) of the light barrier 52. The timing switch 71 triggered in this manner is, on the contrary, reset already after 60 milliseconds into its position of rest, so that the clutch 30 and the brake 35 can be activated only during this short time period. This time period, the value of which is given only by way of example, is designed in such a manner that, based on the selected conveyor speed, it corresponds to the path of the called item 1' from the light barrier 52 to the gripping zone of the feed rollers 43, 44.

It is to be understood that the apparatus according to the invention is not limited to the structural details of, for example, the retaining mechanism, the withdrawing mechanism and the arrangement for moving and refilling the stack 1. For example, the retaining mechanism may be constituted by a roller rotating in reverse, the withdrawing mechanism may be constituted solely by a withdrawing roller without a withdrawing belt and the items may be automatically conveyed by an intermediate stacker by means of a movable stacking carriage.

It is advantageous if the distance between the feed rollers 43, 44 and the principal gripping zone of the withdrawing mechanism is smaller than the length of the shortest item. The location of the principal gripping zone of the withdrawing mechanism is given in the first embodiment by the position of the withdrawing roller 24.

Turning now to FIG. 5, there is illustrated another embodiment of the invention which prevents with increased reliability a simultaneous double withdrawal of items from the stack. This embodiment includes a serial arrangement of two assemblies, each designed according to the first embodiment. It is noted that a serial arrangement of two item separators in such a manner that the downstream separator transmits a call signal for the upstream separator is generally known, for example, from German Patent No. 1,187,246.

Figure 6:
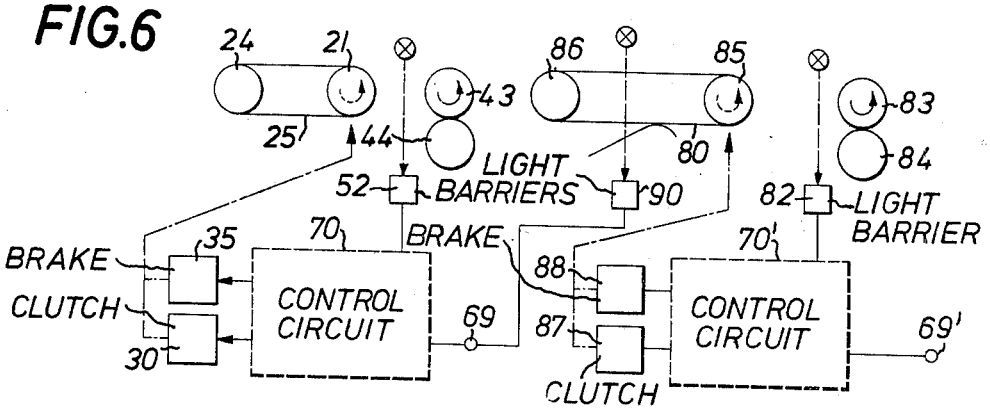
FIG. 6 is a block diagram of a control circuit adapted to be associated with the embodiment illustrated in FIG. 5.

The left-hand side of the embodiment illustrated in FIG. 5 up to and including the feed rollers 43, 44 corresponds to the apparatus described in FIGS. 1, 2 and 4, so that no detailed descriptions of these components is necessary here. Downstream of the feed rollers 43, 44 there is disposed, in the conveying path of the items a second apparatus having an endless withdrawing belt 80, a stripper (retaining mechanism) 81, a light barrier 82, 82' and a pair of continuously driven feed rollers 83 and 84. The withdrawing belt 80 is trained about rollers 85 and 86 which are supported on the base plate 7'. The roller 85, similarly to the roller 21 of the first withdrawing belt 25, may be driven through an electromagnetic clutch 87 and may be arrested in its motion by means of an electromagnetic brake 88 (FIG. 6). Opposite the second withdrawing belt 80 there is disposed a leaf spring 89 secured to the base plate 7' and serving as a guiding and pressing element.

As it may be observed from the block diagram illustrated in FIG. 6, there is provided a control circuit 70 according to FIG. 4 for the control of the clutch 30 and the brake 35 of the drive of the first withdrawing belt 25. For the control of the clutch 87 and the brake 88 of the drive of the second withdrawing belt 80 there is provided a control circuit 70' of the same design. An item 1' forwarded by the feed rollers 43, 44 to the zone of the withdrawing belt 80 is thus, according to the above-described mode of operation, first displaced only to the light barrier 82, 82' and only upon the application of a call signal applied through the terminal 69' of the control circuit 70' is the item transported from this second standby position further to the gripping zone of the second feed rollers 83, 84.

The signal to be applied to the first control circuit 70 for calling the items from their first standby position is transmitted by a sensor mechanism which is disposed in the zone of the second apparatus. Such a signal is given when in the second apparatus no item is present. Such a sensor mechanism may be constituted by the second light barrier 82 which, for this purpose, is also connected to the input terminal 69 of the control circuit 70. It is, however, more expedient to provide, for the purpose of generating a call signal for the control circuit 70, a third light barrier 90, 90' which is disposed in the zone of the second withdrawing belt 80 upstream of the stripper 81 and which is connected to the input terminal 69.

The operation of the assembly illustrated in FIGS. 5 and 6 may be summarized as follows:

It is assumed that upon energization of the apparatus all the light barriers 52, 90 and 82 are clear (undarkened). As a result, both withdrawing belts 25 and 80 start their run. Consequently, from the stack 1 there is withdrawn an item 1'. Because to the input terminal 69 of the first control circuit 70 there is already applied the call signal of the light barrier 90, this call signal will become immediately effective when the light barrier 52 is darkened by an item and thus there will be applied a signal also to the second input of the AND gate 64 (FIG. 4) through the inverter 61. Stated differently, the clutch 30 remains closed and the item is in the described manner advanced into the gripping zone of the feed rollers 43, 44. Therefrom the item is admitted without interruption between the still running second withdrawing belt 80 and the leaf spring 89 and further it is advanced to the second standby position at the light barrier 82. As the item reaches the light barrier 82, the withdrawing belt 80 stops. After this item cleared with its trailing edge the light barrier 52 of the first apparatus, the withdrawing belt 25 has advanced a further item to the first standby position at the light barrier 52. Thus, both standby positions are occupied by an item.

If now, by means of an external call signal applied through the input terminal 69', the item in the second standby position at the light barrier 82 is called, the thus cleared light barrier 90 emits a call signal to the first apparatus so that the item dwelling in the first standby position is advanced into the second standby position.

If, however, in the zone of the second apparatus at the withdrawing belt 80 there are disposed two items because of a simultaneous double withdrawal (the second item, upon calling the item in the second standby position, has been retained by the stripper 81), then the light barrier 90 remains, as before, darkened by the second item, even if the latter, because of the undarkening of the light barrier 82, is admitted to the second standby position.

Therefore, the light barrier 90 calls a further item from the first standby position only if, in response to the subsequent external call signal, the second item too, has been advanced from the second standby position to the zone of the feed rollers 83 and 84 and advanced by the latter.

Within the framework of the invention the call signal may be generated either by an independent external signal generating source or a signal source which is functionally coupled with the apparatus. The embodiment described above in connection with FIG. 6 illustrates an example of such a coupling, wherein as a signal source for the first apparatus, there is provided a sensor mechanism disposed in the second apparatus. The forwarding of the items to the further conveyor path is effected here, similar to the embodiment in FIG. 1, in response to an external call signal applied to the input terminal 69' of the control circuit 70'.

Turning now to FIGS. 7–10, there are illustrated further embodiments of the invention wherein a signal source which is functionally coupled to the forwarding apparatus, generates a call signal to effect the item feed in automatic sequence.

Figure 7:
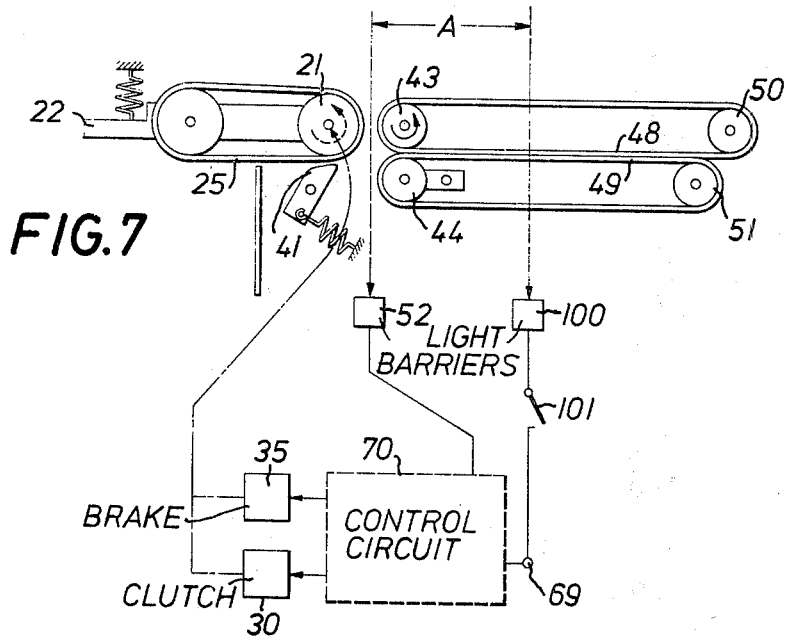
FIG. 7 is a schematic plan view of a first modification of the first embodiment and its control illustrated in FIGS. 1 and 4, respectively.

In the FIG. 7 modification of the embodiment illustrated in FIG. 1, in the zone of the conveyor belts 48 and 49 trained about the feed rollers 43 and 44, respectively, there is disposed a light barrier 100. The distance A of the light barrier 100 from the sensor 52 corresponds to the desired distance between two successive items to be called, that is, the distance between the trailing edge of a leading item and the leading edge of the successive, trailing item. The output of the light barrier 100 may be connected through a switch 101 to the input terminal 69 of the control circuit 70.

When the apparatus illustrated in FIG. 7 is energized, the light barrier 52 is clear (undarkened), so that, as it has been explained in connection with FIGS. 1 and 4, by operating the clutch 31 and releasing the brake 35, the drive of the withdrawing belt 25 is rotating until an item is withdrawn from the stack and advanced to a position in which its leading edge darkens the light barrier 52. If now the switch 101 is closed, then the signal of the still undarkened light barrier 100 is applied, as a call signal, to the input terminal 69. Because of the simultaneous absence of the signal from the light barrier 52, as it was already explained in connection with the embodiment illustrated in FIGS. 1 and 4, the drive of the withdrawing belt 25 is again energized and this energization is maintained until the item arrives into the gripping zone of the feed rollers 43, 44.

The subsequent darkening of the light barrier 100 by the leading edge of the item has no further effect, since the drive of the withdrawing belt 25 had already been de-energized. As soon as the trailing edge of the item clears the light barrier 52, the withdrawing belt 25 removes a second item from the stack and, until a darkening of the light barrier 52 occurs, advances it into the standby position. As soon as the trailing edge of the first item clears the light barrier 100, the latter emits a further call signal to the control circuit 70 and, as a result, by means of the withdrawing mechanism 25, the second item is advanced into the gripping zone of the feed rollers 43, 44.

Figure 8:
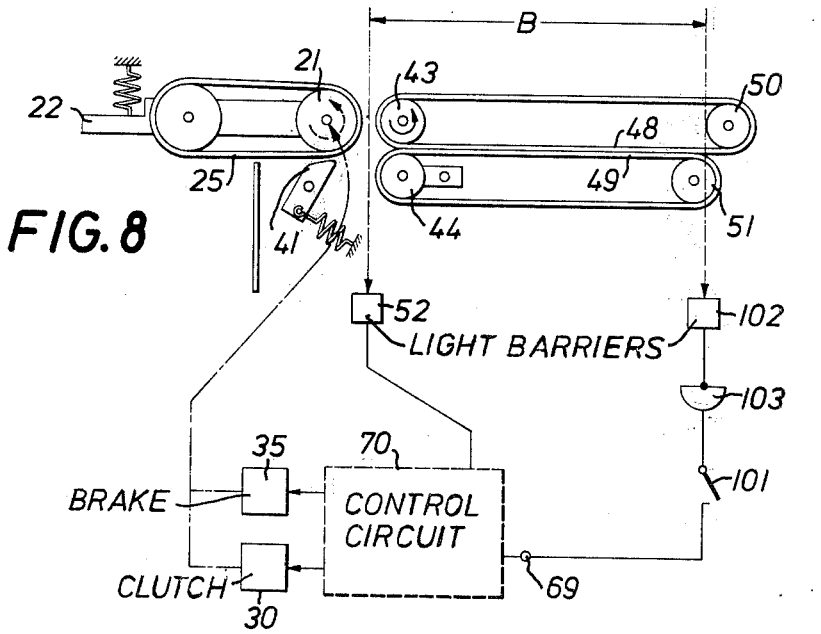
FIG. 8 is a schematic plan view of a second modification of the first embodiment and its control circuit illustrated in FIGS. 1 and 4, respectively.

The FIG. 8 modification of the embodiment illustrated in FIG. 1 differs from that shown in FIG. 7 in that in the zone of the further conveyor path along the conveyor belts 48 and 49 there is arranged a light barrier 102 which has, from the light barrier 52, a distance B which corresponds to the desired distance between the leading edges of two successive items to be called. Between the light barrier 102 and the input terminal 69 of the control circuit 70 there is further connected an inverter 103, so that a call signal will be applied to the control circuit 70 when the light barrier 102 is darkened by the leading edge of the leading item.

The embodiment illustrated in FIG. 6 can be similarly modified to provide an automatic sequential transportation of items.

Figure 9:
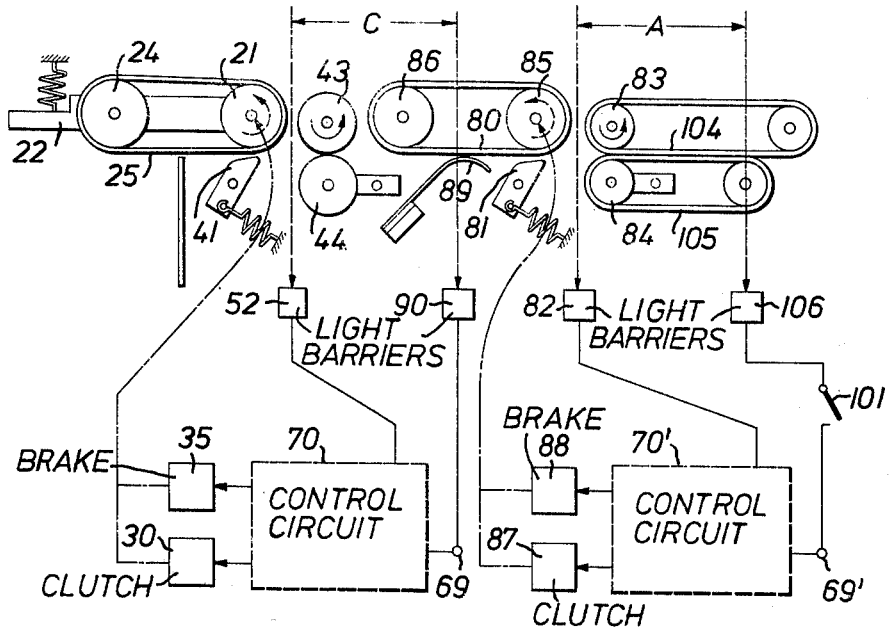
FIG. 9 is a schematic plan view of a first modification of the second embodiment and its control circuit illustrated in FIGS. 5 and 6, respectively.

In the FIG. 9 modification of the embodiment illustrated in FIG. 6 there is shown a conveyor path defined by conveyor belts 104 and 105 trained about feed rollers 83 and 84, respectively. In the zone of this conveyor path there is provided a light barrier 106, the distance A of which from the light barrier 82 corresponds to the desired distance between two successively conveyed items. The mode of operation of this embodiment with regard to the generation of the call signal corresponds to that of the FIG. 7 embodiment with the difference that here, instead of the individual apparatus with withdrawing belt 25, light barrier 52, feed rollers 43, 44 and the control circuit 70, there is provided the second apparatus already described in connection with FIG. 6 and comprising the withdrawing belt 80, the light barrier 82, the feed rollers 83, 84 and the control circuit 70'. The call signal is generated by the light barrier 106 instead of the light barrier 100. In general, in this embodiment the distance C between the light barriers 52 and 90 is identical to the distance A and thus corresponds to the desired distance between two successive items. An increase of the distance C would be permissible if the conveying speeds are rendered unequal in such a manner that at least the circumferential speed of the feed rollers 43, 44 and expediently also the speed of the withdrawing belt 80 are greater than the conveying speed of the conveyor belts 104, 105.

Figure 10:
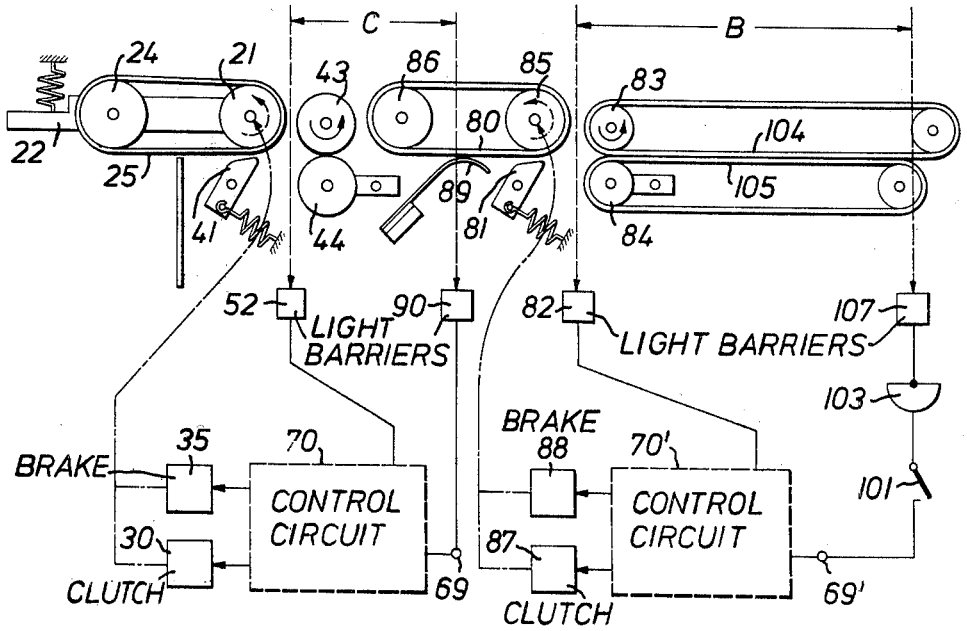
FIG. 10 is a schematic plan view of a second modification of the second embodiment and its control circuit illustrated in FIGS. 5 and 6, respectively.

The FIG. 10 modification differs from the embodiment shown in FIG. 9 in that a further light barrier 107 is disposed in the zone of the conveyor belts 104, 105. The light barrier 107 has a distance B from the light barrier 82 which corresponds to the desired distance between the leading edges of two successive items to be called. Similarly to the apparatus illustrated in FIG. 8, here again, between the light barrier 107 and the input terminal 69' of the control circuit 70' there is connected an inverter 103 so that similarly to the mode of operation of the device discussed in connection with FIG. 8, to the control circuit 70' there is applied a call signal when the light barrier 107 is darkened by the leading edge of the leading item.

It will be understood that the above description of the present invention is susceptible to various modifications, changes and adaptations, and the same are intended to be comprehended within the meaning and range of equivalents of the appended claims.

We claim:

1. An apparatus for forwarding flat items individually from a stack, including means for supporting the stack; a withdrawing means having a principal gripping zone and being in frictional contact with the foremost item in the stack for forwarding the item to a standby position; a retaining mechanism being urged into contact with the withdrawing means; feed means disposed downstream of the standby position and having an item gripping zone; means generating a call signal; and advancing means for forwarding, upon receipt of the call signal, the item from its standby position into the gripping zone of the feed means; the improvement comprising in combination:

a. an item-moving mechanism being in continuous frictional contact with the foremost item in the stack and constituting, in a single structure, both said withdrawing mechanism and said advancing means; said item-moving mechanism including means for advancing the item in a direction parallel to its own plane;

b. drive means coupled to said item-moving mechanism for operating the same; said drive means having an energized state in which said item-moving mechanism is in an operating phase and a de-energized state in which said item-moving mechanism is in a non-operating phase;

c. a sole sensor positioned between the gripping zone of the feed means and the retaining mechanism for sensing the item as the latter arrives into the standby position; the distance between said principal gripping zone and said sole sensor being smaller than the shortest possible length of an item;

d. a control circuit connected to said sensor and said drive means, said control circuit including 1. input means for receiving the call signal;
2. means for energizing said driving means only when said sensor senses no item present;
3. means for energizing said drive means only when said sensor senses the presence of an item and the call signal is applied to said input means; and
4. means for de-energizing said drive means upon sensing the presence of an item by said sensor; and e. means for stopping and restarting the motion of said item-moving mechanism for arresting the item in its own plane in said standby position upstream of said gripping zone of said feed means when said sensor senses the presence of the item and for subsequently advancing the item as a whole into the gripping zone of the feed means when said call signal is received by said input means.

2. An apparatus as defined in claim 1, said means for stopping said item-moving mechanism including a brake connected to said item-moving mechanism to stop the latter when said brake is applied; and means connecting said control circuit to said brake for applying the same to brake said item-moving mechanism to a stop simultaneously with the de-energizing of said drive means.

3. An apparatus as defined in claim 1, further comprising means for rendering the call signal ineffective upon introduction of an item into the gripping zone of said feed means.

4. An apparatus as defined in claim 3, wherein said sale sensor is a first sensor, said means for rendering the call signal ineffective comprises a second sensor connected to said control circuit and situated in said gripping zone of said feed means for sensing the presence of an item; and means for maintaining said drive means energized during the application of said call signal to said input means only as long as said second sensor senses no item present.

5. An apparatus as defined in claim 3, wherein said control circuit includes a timing means connected at least indirectly to said input means and said drive means for maintaining said drive means energized only for a predetermined period from the moment the call signal is applied, said period corresponding to the duration of the travel of an item from said sensor to said gripping zone of said feed means.

6. An apparatus as defined in claim 3, wherein said sale sensor is a first sensor, the improvement further comprising a second sensor disposed in the zone of said feed means at a distance from said first sensor, said distance being equal to the desired distance between leading edges of two successive items advanced by the apparatus, said second sensor being connected to said input means of said control circuit; a signal applied by said second sensor to said input means of said control circuit upon sensing the presence of an item constitutes said call signal said call signal effecting successive automatic conveyance of items from said stack.

7. An apparatus as defined in claim 1, wherein sale sensor is a first sensor, the improvement further comprising a second sensor disposed in the zone of said feed means at a distance from said first sensor, said distance being equal to the desired distance between two successive items advanced by the apparatus, said second sensor being connected to said input means of said control circuit; a signal applied by said second sensor to said input means of said control circuit upon absence of an item constitutes said call signal, said call signal effecting successive automatic conveyance of items from said stack.

8. An apparatus for forwarding flat items individually from a stack, including means for supporting the stack; a withdrawing mechanism being in frictional contact with the foremost item in the stack for forwarding the item to a standby position; drive means for operating the withdrawing mechanism; a retaining mechanism being urged into contact with the withdrawing mechanism; feed means disposed downstream of the standby position and having an item gripping zone; a sensor positioned between the gripping zone of the feed means and the retaining mechanism for sensing the item as the latter arrives into the standby position; means generating a first call signal; and advancing means for forwarding, upon receipt of the first call signal, the item from its standby position into the gripping zone of the feed means, the improvement comprising in combination:

a. a control circuit connected to said sensor and said drive means, said control circuit including
   1. input means for receiving the first call signal;
   2. means for energizing said drive means only when said sensor senses no item present;
   3. means for energizing said drive means only when said sensor senses the presence of an item and the first call signal is applied to said input means; and
   4. means for de-energizing said drive means upon sensing the presence of an item by said sensor;

b. means for stopping said withdrawing mechanism for arresting the item in said standby position upstream of said gripping zone when said sensor senses the presence of the item; said withdrawing mechanism also constituting said advancing means; said withdrawing mechanism, said retaining mechanism, said sensor, said feed means, said control circuit and said means for stopping said withdrawing mechanism constituting a first assembly;

c. an additional withdrawing mechanism disposed downstream of said feed means;

d. an additional retaining mechanism being urged into contact with said additional withdrawing mechanism;

e. an additional feed means disposed downstream of said additional withdrawing mechanism and having a gripping zone;

f. A first additional sensor disposed between the gripping zone of said additional feed means and said additional retaining mechanism for sensing the item as the latter arrives in a standby position upstream of the gripping zone of said additional feed means;

g. a pressing element disposed upstream of said additional retaining mechanism and urged into contact with said additional withdrawing mechanism;

h. a second additional sensor disposed in the zone of said additional withdrawing mechanism upstream of said additional retaining mechanism for sensing the presence of an item, said second additional sensor being connected to said input terminal of said control circuit of said first assembly for applying thereto said first call signal when said second additional sensor senses no item present; and i. an additional control circuit connected to said first additional sensor and at least indirectly to said second withdrawing mechanism, said additional control circuit including
   1. input means for receiving a second call signal;
   2. means for temporarily energizing said additional withdrawing mechanism for forwarding each item, advanced by said first assembly, into the standby position at said first additional sensor; and
   3. means for temporarily energizing said additional withdrawing mechanism for forwarding each item from the standby position at said first additional sensor into the gripping zone of said additional feed means upon application of the second call signal to said input means of said additional circuit; the components (c) to (i) constituting a second assembly.

9. An apparatus as defined in claim 8, further comprising a third additional sensor disposed in the zone of said additional feed means at a distance from said first additional sensor, said distance being equal to the desired distance between two successive items advanced by the apparatus, said third additional sensor being connected to said input means of said additional control circuit; a signal applied by said third additional sensor to said input means of said additional control circuit upon sensing the absence of an item constitutes said second call signal, said second call signal effecting successive automatic conveyance of items from said stack.

10. An apparatus as defined in claim 8, further comprising means for rendering the first call signal applied to the input terminal of the control circuit of said first assembly ineffective upon introduction of an item into the gripping zone of said feed means of said first assembly; a third additional sensor disposed in the zone of said additional feed means at a distance from said first additional sensor, said distance being equal to the desired distance between leading edges of two successive item advance by the apparatus, said third additional sensor being connected to said input means of said additional control circuit; a signal applied by said third additional sensor to said input means of said additional control circuit upon sensing the presence of an item constitutes said second call signal, said second call signal effecting successive automatic conveyance of items from said stack.

11. An apparatus for forwarding flat items individually from a stack, including means for supporting the stack; a withdrawing mechanism being in frictional contact with the foremost item in the stack for forwarding the item to a standby position; drive means for operating the withdrawing mechanism; a retaining mechanism being urged into contact with the withdrawing mechanism; feed means disposed downstream of the standby position and having an item gripping zone; a sensor positioned between the gripping zone of the feed means and the retaining mechanism for sensing the item as the latter arrives into the standby position; means generating a first call signal and advancing means for forwarding, upon receipt of the first call signal, the item from its standby position into the gripping zone of the feed means, the improvement comprising in combination:

a. a control circuit connected to said sensor and said drive means, said control circuit including
   1. input means for receiving the first call signal;
   2. means for energizing said drive means only when said sensor senses no item present;
   3. means for energizing said drive means only when said sensor senses the presence of an item and the first call signal is applied to said input means; and 4. means for de-energizing said drive means upon sensing the presence of an item by said sensor;

b. means for stopping said withdrawing mechanism for arresting the item in said standby position upstream of said gripping zone when said sensor senses the presence of the item; said withdrawing mechanism also constituting said advancing means; said withdrawing mechanism, said retaining mechanism, said sensor, said feed means, said control circuit and said means for stopping said withdrawing mechanism constitute a first assembly;

c. an additional withdrawing mechanism disposed downstream of said feed means;

d. an additional retaining mechanism being urged into contact with said additional withdrawing mechanism;

e. an additional feed means disposed downstream of said additional withdrawing mechanism and having a gripping zone;

f. an additional sensor disposed between the gripping zone of said additional feed means and said additional retaining mechanism for sensing the item as the latter arrives in a standby position upstream of the gripping zone of said additional feed means, said additional sensor applying to said input means said first call signal when said additional sensor senses no item present;

g. a pressing element disposed upstream of said additional retaining mechanism and urged into contact with said additional withdrawing mechanism;

h. an additional control circuit connected to said additional sensor and at least indirectly to said second withdrawing mechanism, said additional control circuit including 1. input means for receiving a second call signal;
2. means for temporarily energizing said additional withdrawing mechanism for forwarding each item, advanced by said first assembly, into the standby position at said additional sensor; and
3. means for temporarily energizing said additional withdrawing mechanism for forwarding each item from the standby position at said additional sensor into the gripping zone of said additional feed means upon application of the second call signal to said input means of said additional circuit; the components (c) to (h) constituting a second assembly.

* * * * *

UNITED STATES PATENT AND TRADEMARK OFFICE

CERTIFICATE OF CORRECTION

PATENT NO. : 3,981,493

DATED : September 21st, 1976

INVENTOR(S) : Karl Klappenecker et al

It is certified that error appears in the above-identified patent and that said Letters Patent are hereby corrected as shown below:

In the heading of the patent, under [30] Foreign Application Priority Data, change "2309765" to --2309756--.

Column 1, line 40, before "is" insert --which--.

Column 2, line 21, after "control" insert --circuit--.

Column 9, line 67, change "driving" to --drive--.

Column 10, line 21, change "de-energizing" to --de-energization--; line 28, change "sale" to --sole--; line 46, change "sale" to --sole; line 57, change "sale" to --said sole--.

Column 11, line 45, change "A" to --a--.

Column 12, line 34, change "advance" to --advanced--; line 55, change "signal" to --signal;--.

Signed and Sealed this

Fifteenth Day of February 1977

[SEAL]

*Attest:*

RUTH C. MASON
*Attesting Officer*

C. MARSHALL DANN
*Commissioner of Patents and Trademarks*